US006116852A

United States Patent [19]

Pierre et al.

[11] Patent Number: 6,116,852

[45] Date of Patent: Sep. 12, 2000

[54] TURBINE PASSIVE THERMAL VALVE FOR IMPROVED TIP CLEARANCE CONTROL

[75] Inventors: Sylvain Pierre, Mesa, Ariz.; Martin John Dobson, Montreal, Canada

[73] Assignee: Pratt & Whitney Canada Corp., Longueil, Canada

[21] Appl. No.: 08/989,173

[22] Filed: Dec. 11, 1997

[51] Int. Cl.[7] ..... F01D 9/02

[52] U.S. Cl. ..... 415/115; 415/116; 415/138; 415/173.3; 415/176

[58] Field of Search ..... 415/115, 116, 415/117, 136, 138, 139, 176, 178, 173.1, 173.2, 173.3

[56] References Cited

U.S. PATENT DOCUMENTS

| | | | |
|---|---|---|---|
| 3,575,528 | 4/1971 | Beam, Jr. et al. | 416/97 R |
| 3,736,069 | 5/1973 | Beam, Jr. et al. | 415/115 |
| 3,814,313 | 6/1974 | Beam, Jr. et al. . | |
| 3,966,354 | 6/1976 | Patterson | 416/116 |
| 3,975,901 | 8/1976 | Hallinger et al. | 415/115 |
| 4,023,731 | 5/1977 | Patterson | 415/116 |
| 4,541,775 | 9/1985 | Hovan | 415/115 |
| 4,613,280 | 9/1986 | Tate . | |
| 4,730,982 | 3/1988 | Kervistin . | |
| 4,804,310 | 2/1989 | Fuller et al. | 415/115 |
| 4,805,398 | 2/1989 | Jourdain et al. | 60/39.75 |
| 5,054,996 | 10/1991 | Carreno | 415/115 |
| 5,064,343 | 11/1991 | Mills | 415/115 |
| 5,273,396 | 12/1993 | Albrecht et al. | 415/173.1 |
| 5,314,303 | 5/1994 | Charbonnel et al. | 415/173.1 |
| 5,316,437 | 5/1994 | Czachor | 415/115 |
| 5,351,732 | 10/1994 | Mills et al. | 415/115 |
| 5,407,320 | 4/1995 | Hutchinson | 415/116 |
| 5,649,806 | 7/1997 | Scricca et al. | 415/115 |

*Primary Examiner*—F. Daniel Lopez
*Assistant Examiner*—Richard Woo
*Attorney, Agent, or Firm*—Jeffrey W. Astle

[57] ABSTRACT

A gas turbine engine blade tip clearance control system and method is described. An annular housing is formed about an engine casing to which an annular shroud segment assembly is secured and closely spaced about blade tips of a stage of blades. The annular housing forms an air passage means communicating with the casing for directing a cooling air stream to the casing. A thermally operable passive ring valve is formed by two overlapped metal ring segments having a dissimilar coefficient of thermal expansion selected whereby to produce a radial gap between the ring segments when the valve temperature reaches a predetermined value. The radial gap admits a cooling air flow into the housing for cooling the casing and its associated shroud segment assembly to control radial growth and thereby prevent blade tip pinching.

8 Claims, 5 Drawing Sheets

TURBINE PASSIVE THERMAL VALVE FOR IMPROVED TIP CLEARANCE CONTROL

TECHNICAL FIELD

The present invention relates to a gas turbine engine blade tip clearance control system and method utilizing a thermally operable passive valve whereby to control radial growth of the shroud segment support casing at low and high power settings of the engine.

BACKGROUND ART

The present invention is directed at remedying the problem in gas turbine engines wherein the tips of the turbine blades of the engine penetrate the linings of the shroud segments which surround them and thereby destroy the desired clearance therebetween with resulting loss in efficiency in certain flight conditions. Various attempts have been made at remedying the problem of controlling radial growth of the casing about the turbine blades during take-off and other transient operating conditions of the engine where the difference between blade tip and casing growth is greater. During transient conditions it is desirable to keep the casing hot whereas in steady state conditions, it is desired to cool the casing.

Former solutions to attempt to control the gap between the blade tips and the shroud segments have involved the use of large mechanical valves and piping which had to be accommodated in the spaces provided in the engine compartment. These valves and associated piping were very large in size and accordingly occupied critical spaces and provided added weight and cost to the engine.

In some of the attempts to remedy the above-noted problem some have resorted to the use of proportioners which utilize metering devices which permit the supply of hot or cold or mixed air to the shroud plenum. Such a device is for example described and illustrated in U.S. Pat. No. 5,064,343 issued on Nov. 12, 1991. The proportioner as illustrated therein controls the amount of hot or cold air going to the plenum above the rotor shroud in order to control tip clearance with engine conditions. This proportioner relies on hot gas temperatures for thermal radial expansion relative to the other static parts which follow the cold air supply temperature. It is this thermal mismatch, combined with appropriate discrete holes which permits metering of hot or cold or mixed air supply to the shroud plenum. The proportioner is a U-shaped ring which moves in and out radially in a slot which implies fretting and possible loss of sealing surface with the static parts. With time, cold air leakage seems unavoidable and this compromises the function of the system.

In U.S. Pat. No. 3,966,354 there is also proposed a thermal actuated valve for clearance control using bleed air from the compressor to supply hot or cooler air to heat or cool the shroud. Their passive thermal valve bypasses cooler air and admits hot air against the shroud from the bleed conduits. The reaction time of expansion and contraction of the shroud is slow in comparison with the reaction time of the rotor blades. The structure proposed also occupies valuable space about the shroud.

SUMMARY OF INVENTION

Contrary to the prior art, the turbine passive thermal valve of the present invention is designed to permit core gas stream ingestion into the shroud segments and turbine support casing at low power settings to heat the shrouds and casing to prevent turbine pinch from occurring, for example, between engine acceleration and deceleration, but to permit the flow of cooling air at high power conditions to optimize engine performance. Also, the passive thermal valve does not rely on any support structure but is attached directly to the turbine support casing to form a plenum over the turbine support casing impingement baffle. Further, the passive thermal valve arrangement proposed occupies a comparably small space envelope. Still further, the airflow used in activating of the passive thermal valve is not used for vane cooling but for cooling the shroud segments.

It is a feature of the present invention to provide a gas turbine engine blade tip clearance control system using a cooling air flow housing having passive ring valve which goes from a tight fit to a radial gap, or loose fit, whereby to admit surrounding cold air into the housing and passage means to cool the casing and the shroud segment assembly.

Another feature of the present invention is to provide a method of controlling the clearance between the tips of a stage of turbine blades and a surrounding annular casing and associated shroud segment assembly of a gas turbine engine by utilizing a cooling air flow housing having a passive ring valve which automatically controls its opening and closure to communicate or arrest cooling air flow in the housing and about the casing and associated shroud assembly.

According to the above features, from a broad aspect, the present invention provides a gas turbine engine blade tip clearance control system which comprises an annular housing formed about an engine casing to which an annular shroud segment assembly is secured and closely spaced about blade tips of a stage of blades. The annular housing forms an air passage means communicating with the casing for directing a cooling air flow to the casing. The engine casing is provided with an annular impingement passage formed therein in a wall surface opposite the annular shroud segment assembly. The impingement passage is defined between opposed spaced annular side walls of the casing. A thermally operable passive ring valve is formed by two overlapped metal ring segments having a dissimilar coefficient of thermal expansion selected whereby to produce a radial gap between the ring segments when the temperature of the ring segments reaches a predetermined value. The radial gap admits a cooling air flow into the housing for cooling the casing to control radial growth. The annular housing is formed by a ring valve support structure above the casing opposite the annular shroud segment assembly. The two overlapped metal rings are integrated in the support structure and are in facial contact. The radial gap is formed by a space between the metal rings when the rings separate from one another due to the dissimilar coefficient of thermal expansion. The radial gap is a variable radial gap the size of which is affected by the temperature of the metal rings to admit a metered cooling air flow to the casing.

According to a still further broad aspect of the present invention there is provided a gas turbine engine incorporating therein the blade tip clearance control system and method of the present invention.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
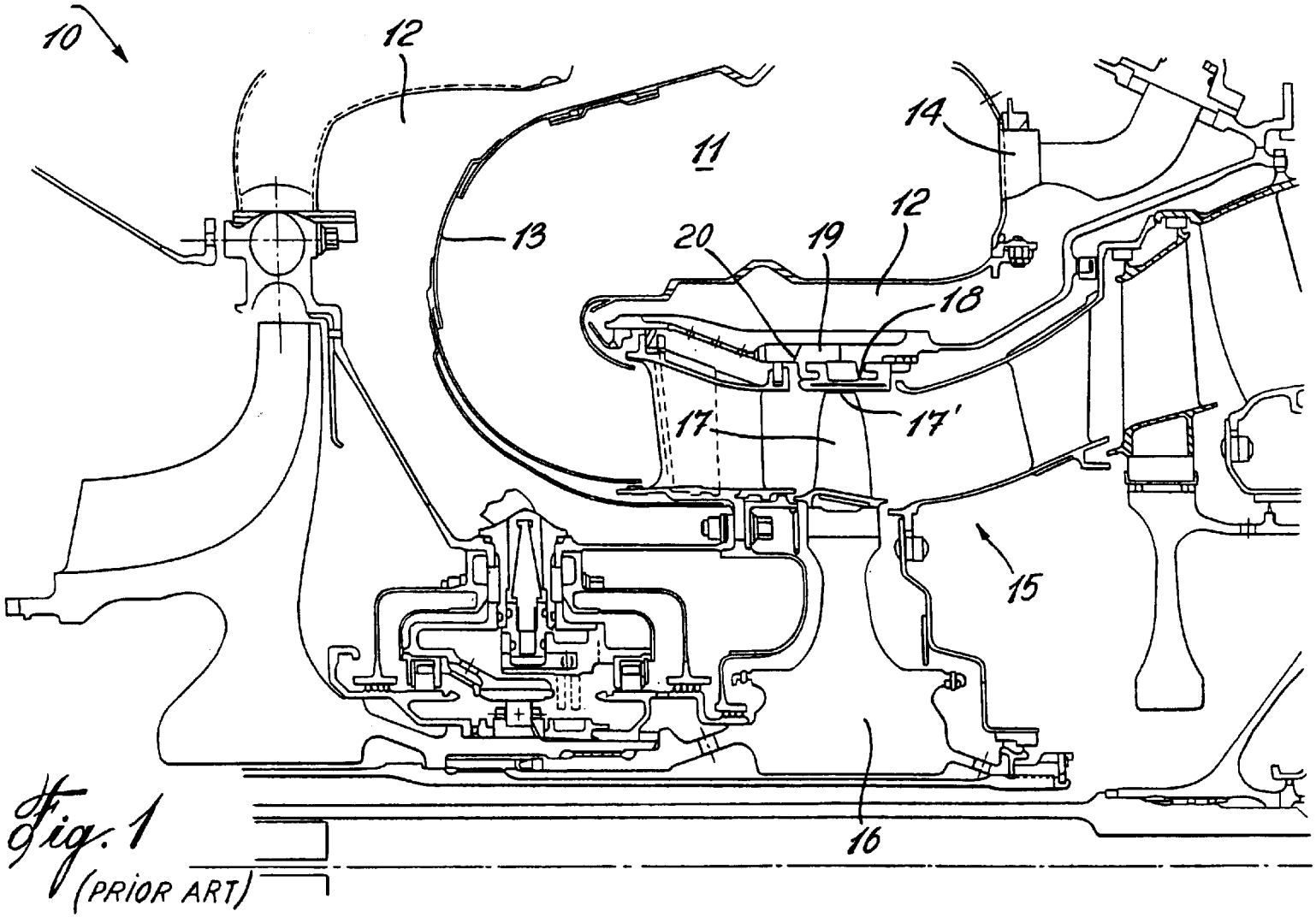
Fig. 1 (PRIOR ART)
FIG. 1 is a section view of the combustion and turbine sections of a gas turbine engine of the prior art.
Figure 2A:
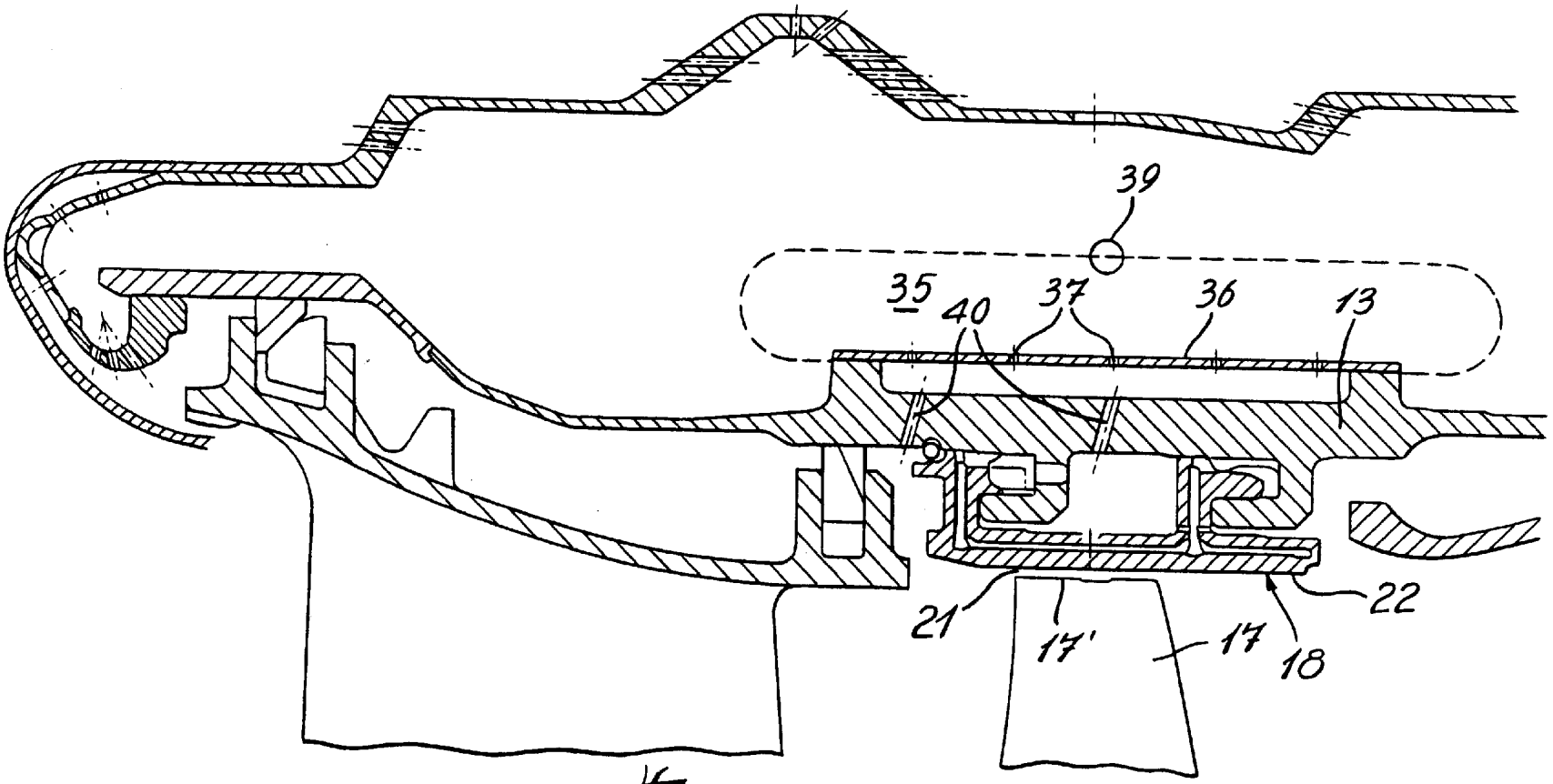
FIGS. 2A to 2C are simplified section views of the front end of the turbine engine and illustrating the operation of the blade tip clearance control system of the present invention.

Referring now to the drawings and more particularly to FIG. 1, there is shown generally at 10 the combustion and high pressure turbine sections of a gas turbine engine of the prior art. The combustion section includes a combustion chamber 11 in which compressor air from the surrounding chamber 12 is admitted through its perforated wall 13 to mix with the fuel entering through the nozzle 14 to create a combustible mixture. This hot gas combustion is usually at temperatures exceeding 2000° F. and is fed into the turbine section 15 where one or more stages 16 of rotor blades 17 are mounted. As hereinshown the tip end 17' of the rotor blade 17 is positioned in close spacing with an annular shroud segment assembly 18. The shroud segment assembly 18 is supported by an annular casing 19. The annular casing 19 is provided with through bores 20 or channels to admit cooling air from the surrounding chamber 12 thereabout and in the area of the annular shroud segment assembly 18 to cool same. However, during transient engine operation the thermal expansion of the rotor blade 17 is much more rapid than that of the annular casing 19 and because the casing is constantly cooled, this can result in turbine pinch between the blade tips and the annular casing, causing undesired wear and therefore loss of turbine efficiency. Therefore, in the prior art, blade/casing clearances are increased to avoid turbine pinch during transient conditions, with a resultant loss of turbine efficiency at ordinary operating conditions. As previously described, it is desirable to control the thermal expansion of the annular casing 19 and hence the annular shroud segment assembly supported thereby to control the tip clearance 21, as shown in FIG. 2A, between the blade tip 17' and the exterior surface 22 of the annular shroud segment assembly 18. The present invention provides a blade tip clearance control system which performs this task automatically as will now be described with further reference to FIGS. 2A to 2C and 3.

The present invention consists in controlling the turbine support casing radial growth at low and high power setting of the engine through a passive valve system to obtain the minimum possible build clearance, and therefore minimum engine operating turbine tip clearance, in the case of turbines where the static component radial growth is done through a cooled housing supporting shroud segments and a turbine rotor. We therefore have a turbine casing which at low power condition has an average metal temperature similar to, or beyond, the high power condition steady-state average temperature. This eliminates turbine pinch clearance occurring during engine acceleration or re-acceleration. To achieve this, the system permits the housing average temperature to be controlled by the hot gas path at low power condition and by the cooling air temperature at high power condition, where the threshold from one to the other is determined by the extra requirement that the system is properly cooled for the cruise condition.

Figure 3:
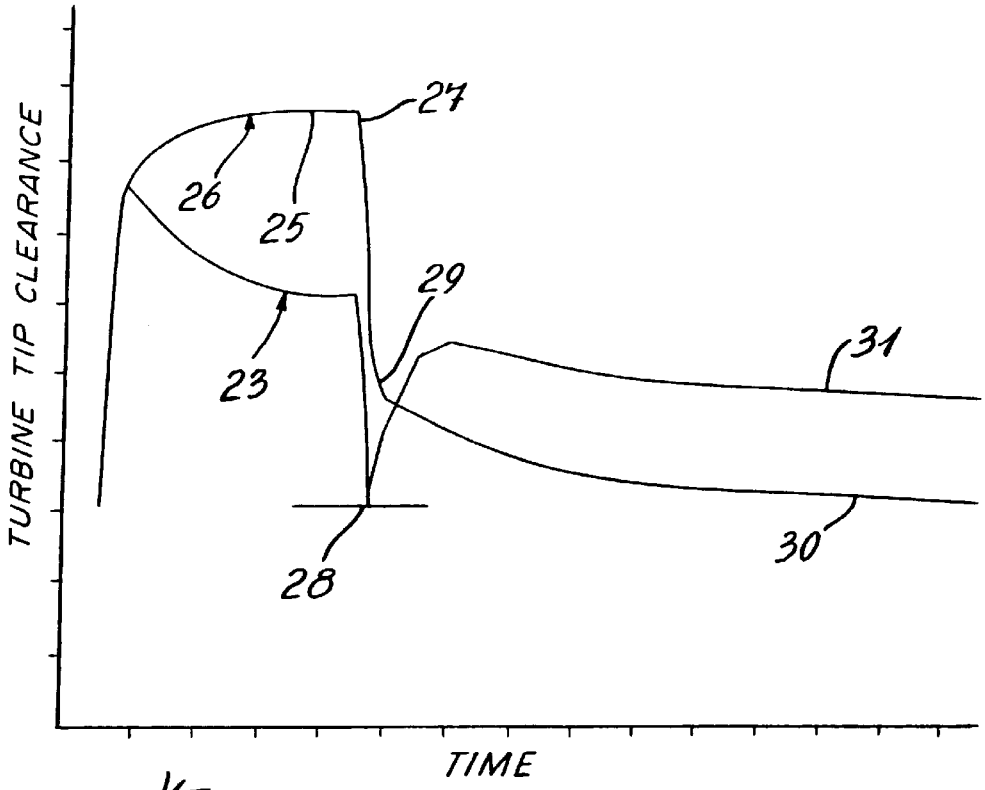
FIG. 3 is a curve diagram showing the turbine tip clearance variation at various engine behaviors.

Referring now to FIG. 3 there are shown two characteristic curves comparing the gap behavior between an engine with and without the blade tip clearance control system of the present invention. The first curve 23 illustrates the turbine tip clearance variation of an engine without the blade tip clearance control system and the second curve 26 illustrates the turbine tip clearance of an engine provided with the tip clearance control system of the present invention. As hereinshown during a deceleration from engine high power the tip clearance of the prior art starts decreasing as shown by the portion 24 of curve 23 because the casing continues to be cooled by the cooling air from surrounding chamber 12 of the engine while the turbine disc temperature does not decrease as rapidly. However, with the present invention during that period, as illustrated at section 25 of curve 26, the casing is maintained hot by the passive valve of the system which is closed during low power conditions, as will be described later. If shortly thereafter the engine is re-accelerated to high power as for example illustrated at position 27 on curve 26, the blade clearance of the prior art engine decreases rapidly towards the pinch point 28. This is due to the fact that the thermal growth of the housing and shroud is not matched with that of the rotor blades. Contrary to this, with the control system of the present invention the passive valve remains closed to prevent cooling of the engine casing until the engine is reaccelerated to high power, at which point the passive valve opens to permit cooling of the engine casing. It can be seen that the tip clearance of the control system of the present invention remains above the pinch point 28, such as shown at 29 on curve 26. As can also be seen, during steady state operation of the engine at high power, with the control system of the present invention the tip clearance is maintained at a close tolerance, as illustrated at section 30 on curve 26, whereas with the prior art the gap or tip clearance is maintained much larger, as illustrated by section 31 of curve 23 to avoid pinching thus resulting in a loss of efficiency of the engine because of this larger gap.

Figure 2B:
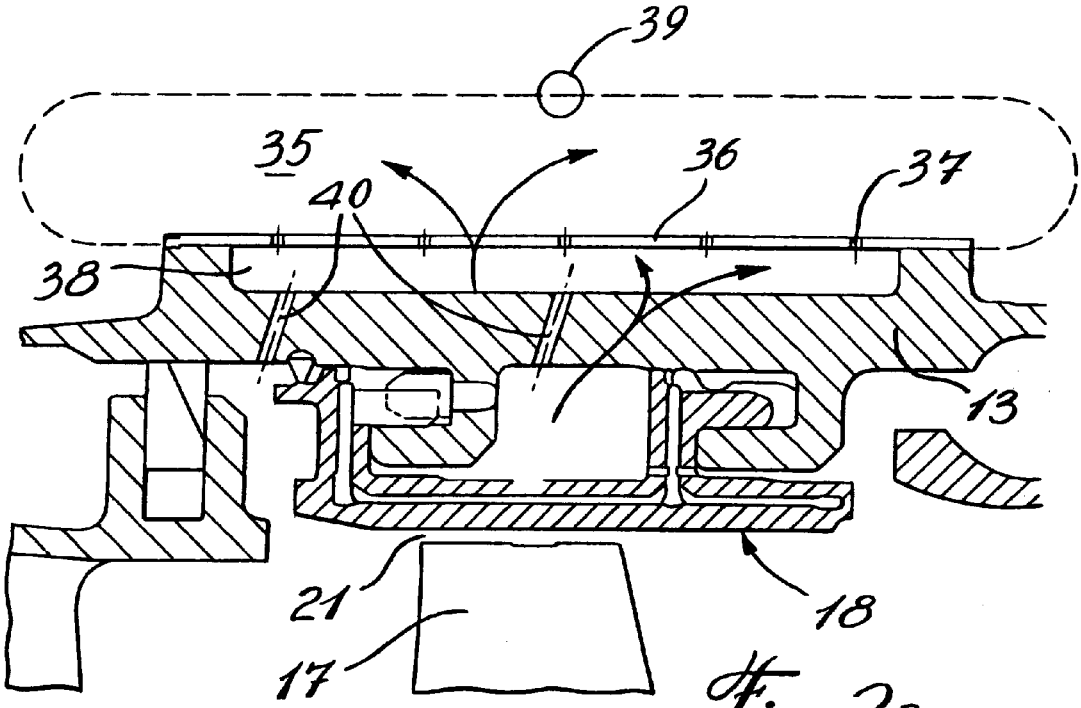

With reference now to FIGS. 2A and 2B, there will be described the concept and operation of the system of the present invention. With the present invention there is constructed an annular chamber 35 defined by a housing 42 formed about the impingement baffle 36 of the engine casing 13. The impingement baffle 36 is provided with holes 37 for admitting into the impingement passage 38 surrounding the casing 13 a cooling air flow through the passive ring valve 39. As shown in FIG. 2B, the passive ring valve 39 is closed when the engine is at low power. Accordingly, hot gas air will flow through the casing 13 and about the shroud segment assembly 18 and into the annular chamber or plenum 35 through the bores 40 of the casing and holes 37 of the impingement baffle 36 causing the casing and the annular shroud segment assembly 18 to absorb heat along with the blade 17 to expand together and maintain a minimal tip clearance 21. This heat in chamber 12 is not sufficient, at low power, to open the passive valve 39.

Figure 2C:
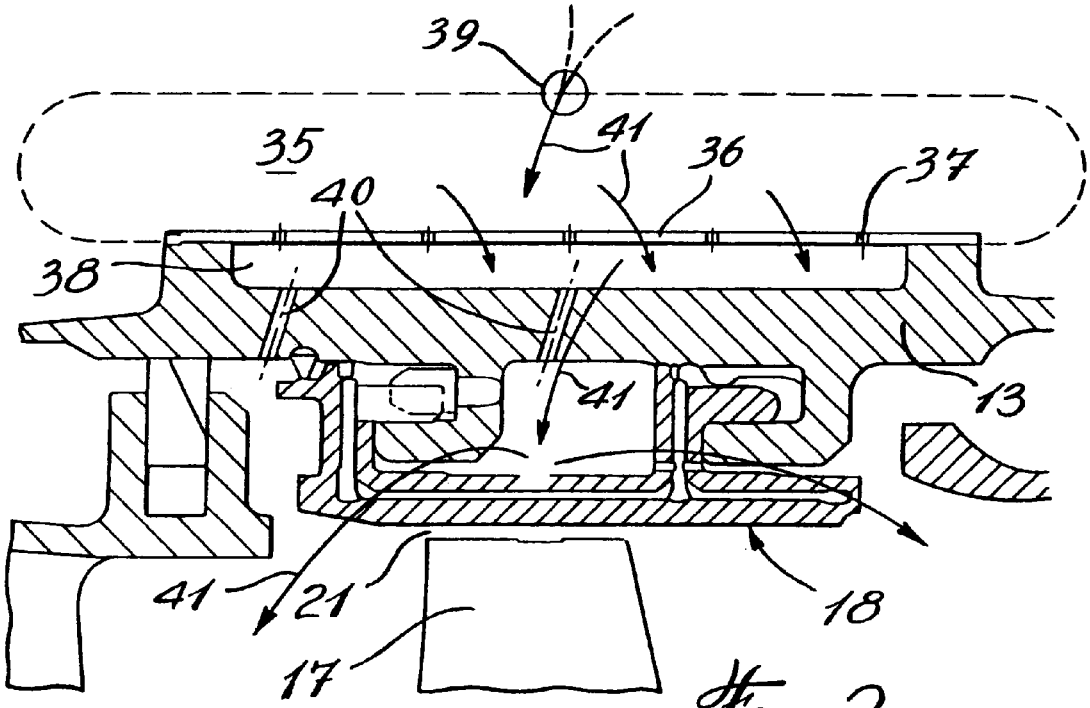

Referring now to FIG. 2C, it can be seen that at high power operation of the engine the passive valve 39 is opened because of the high heat in chamber 12 generated by such operation, passive valve 39 thereby admitting a cooling air flow, as identified by arrows 41, into the housing passage 38 through the impingement baffle 36 and about the casing 13 and then through the casing via the through bores 40 and about the shroud assembly 18, exhausting into the hot gas path. Accordingly, these structures are cooled to limit radial expansion of the casing and the annular shroud segment assembly 18 to maintain the tip clearance gap 21 within minimal acceptable tolerances to provide more efficient operation of the engine at high power.

Figure 4:
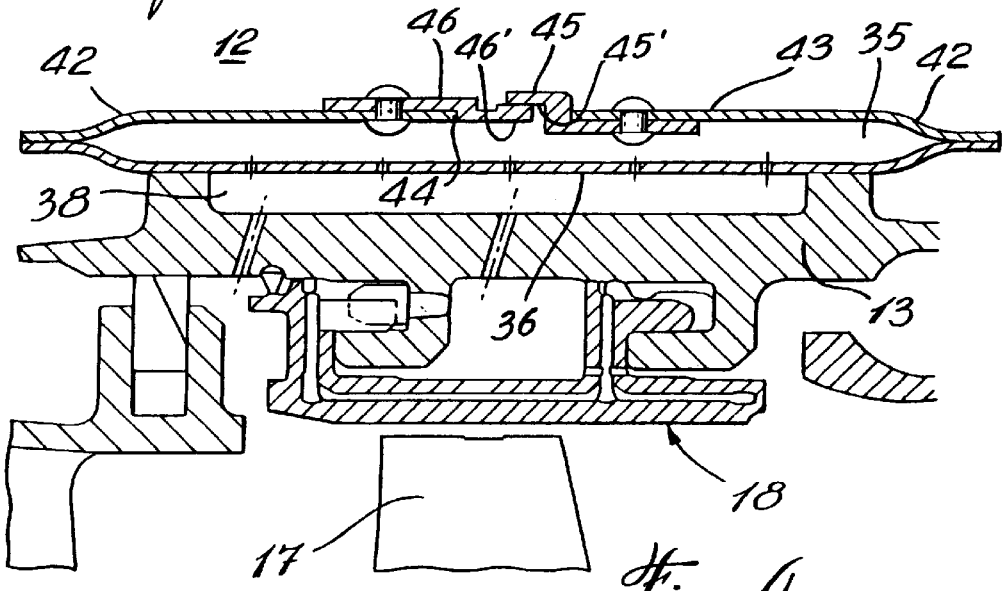
FIG. 4 is a section view similar to FIGS. 2A to 2C but illustrating an embodiment of the blade tip clearance control system of the present invention.

FIG. 4 illustrates one embodiment of the tip clearance control system of the present invention and wherein the housing 42 is formed by support structures 42' which are annular metal sleeves which may be formed of the same material as the casing 13 but this is not essential. As can be seen the top wall 43 of the support structures 42' are spaced to form a gap 44 across which is secured two overlapped metal ring segments 45 and 46 constructed of metals having dissimilar coefficient of thermal expansion. These ring segments 45 and 46 are overlapped at a free end portion 46' and 45' and define therebetween a gap when the segments separate. The support structures 42' and thin overlapping rings 45' and 46' define an enclosure 35 which acts as a plenum 35 when the radial gap 44 is opened. The is plenum 35 permits the air entering through the radial gap 44 to stabilize inside the plenum 35, permitting a uniform feed to the impingement holes of baffle 36 to cool the engine casing 13.

When the rings 45 and 46 are in close frictional contact, such as shown in FIG. 4, corresponding to a low power condition, the radial gap 44 is closed permitting no, or little cooling air to enter the annular chamber 35.

As the temperature of the air within the surrounding chamber 12 increases (as during an engine acceleration to high power), the radially closed gap opens up because of the mismatch of the coefficient of thermal expansion between rings 45 and 46 (45: higher coefficient of thermal expansion, 46: lower coefficient of thermal expansion). This radial gap permits cooling air from 12 to enter the plenum 35 and cool the engine casing through the cooling holes 36 and 40; the size of the radial gap will depend on the choice of material for the mismatch in the coefficient of thermal expansion and will be proportional to the temperature of the surrounding chamber 12.

The size of the rings 45 and 46 is determined to ensure a low thermal inertial relative to the engine casing so that a transient thermal response of 1–10 sec does not affect the engine casing transient response of 2–5 min. (higher thermal inertia).

During an acceleration, the engine casing initial temperature is close to/higher than its final steady state temperature so the transient temperature variation of the casing 13 is small, and therefore there is no transient pinch with the rotor. During a deceleration, from high power to low power, as the initial casing temperature is high, the valve closes quickly and again the transient temperature variation of the engine casing is small; a reacceleration to high power from this sudden deceleration to low power, would see the casing not being very thermally reactive as the initial casing temperature would still be close to its final steady-state temperature. There would be no transient pinch event with the rotor, as previously described and illustrated in FIG. 3.

Figure 5:
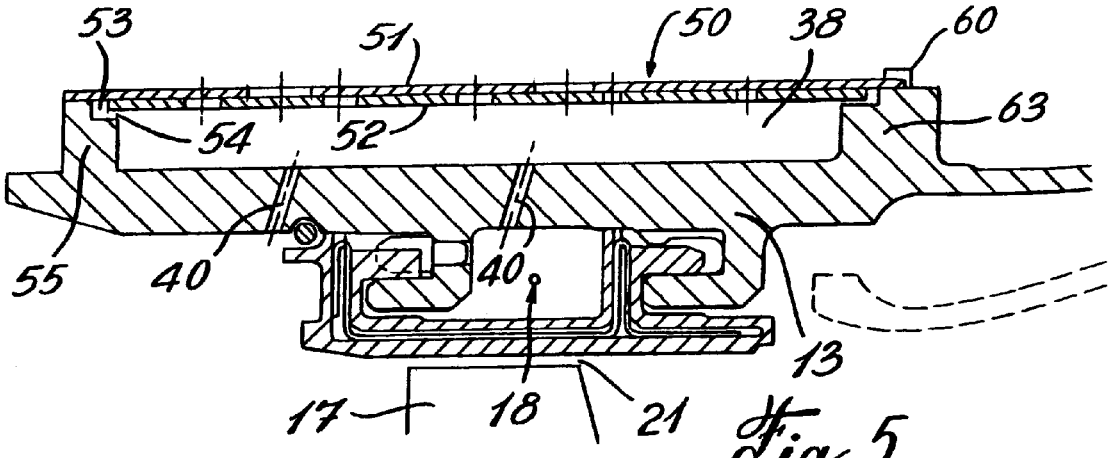
FIG. 5 is a section view similar to FIG. 4 illustrating a further embodiment of the blade tip clearance control system of the present invention.
Figure 6:
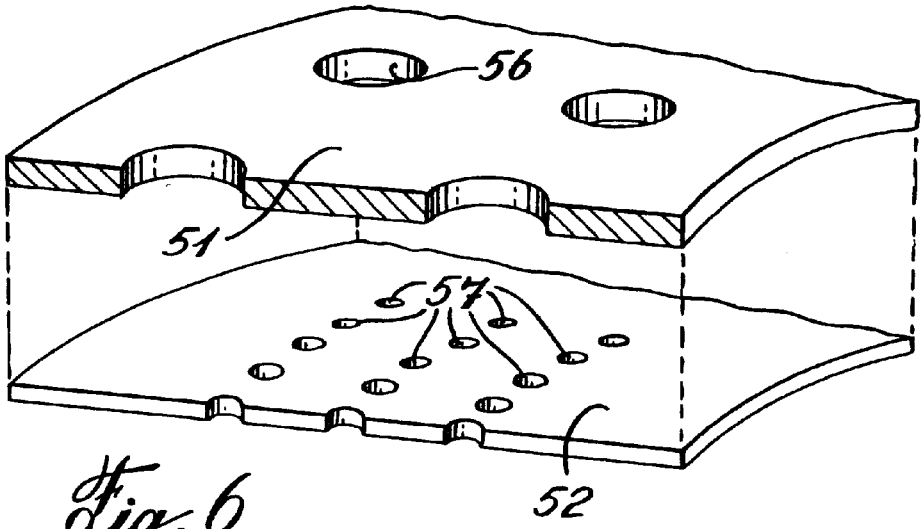
FIG. 6 is a fragmented exploded view showing the construction of the annular metal plates.

FIG. 5 illustrates a further embodiment of the construction of the thermally operable passive ring valve of the present invention at low power condition. As hereinshown, the passive valve ring 50 is constituted by double overlapped baffle plates, namely plate 51 and plate 52. Baffle plate 52 is made of a material having a low coefficient of thermal expansion whereas plate 51 is made of a material having a higher coefficient of thermal expansion. In the illustrated embodiment, baffle plate 51 forms part of the casing 13 and is therefore comprised of the same material as that of the casing 13. These baffle plates 51 and 52 are formed as annular sleeves and supported about the impingement cavity 38 of the casing 13. Support means is provided in the form of a cavity 53 in a top inner edge section 54 of each of the annular side walls 55 defining the impingement passage 38. These cavities 53 are aligned and dimensioned to permit displacement of the plate 52 relative to plate 51 and engine casing 13 to cause the plates 51 and 52 to separate and permit airflow into the impingement passage 38 through passage means provided in the plates.

The passage means in the plates is constituted by equidistantly spaced holes with holes 56 in the top plate being larger than the holes 57 in an impingement cooling pattern in the bottom plate 52. The size and axial location of holes 56 are such that they are not restrictive to the cooling airflow through holes 57, when both plates 51 and 52 are separated. The location of holes 56 are axially offset from 57 so that when the plates are in a tight fit, the holes do not communicate.

Figure 7:
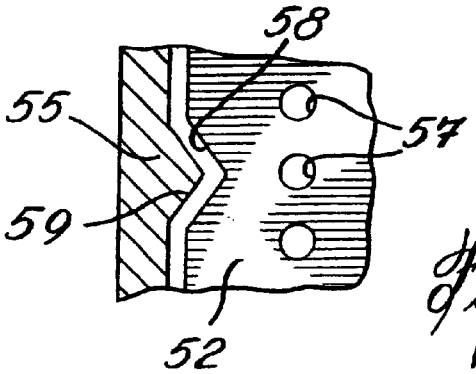
FIG. 7 is a fragmented view illustrating an embodiment of a restriction displacement means to maintain the plates, as shown in FIG. 6, in facial alignment.

As shown in FIG. 7, the plate 52 may be provided with an indentation 58 to align the plate with protrusions 59 provided in the side wall 55 to each side of the impingement passage. A similar indentation is also provided in the top plate 51 for location against an aligning post 60 whereby the plates 51 and 52 are maintained in alignment during expansion of the plates when the valve opens. These plates are initially in a tight fit between one another. At high power, because of the dissimilar coefficient of thermal expansion of these baffle plates, they will separate causing airflow between a gap which is formed between the plates and the holes 56 and 57. The operation is the same as with the first embodiment herein described.

During a transient acceleration/deceleration, the baffle plates 51 and 52 separate/become tight very quickly and provide cooling/no cooling to the casing because of their low thermal inertia (1 to 10 seconds) relative to the casing (1 to 2 minutes) thus ensuring a small average temperature variation of the casing. During acceleration from idle to take-off, as the initial housing temperature is close to, or beyond, the final steady-state take-off temperature, the casing has a small transient temperature variation and transient differential radial growth and therefore there is no pinching between the blade tip and the annular shroud segment assembly. During a deceleration, the casing starts at a high temperature and as the baffle plates quickly go tight together, sealing the casing impingement passage 38, the casing is no longer cooled by the cooling air and gets bathed in hot gas path air, keeping the engine casing temperature close to its initial high power temperature.

During transient events like hot restart/windmill restart, the casing is at a high initial temperature and will take much longer to cool down because the rings 45 and 46 or plates 51 and 52 are in a tight fit, shielding the casing from the cold flow, relative to systems without this passive control system, and therefore provide a better match with the turbine disc slow cool-down period.

It is within the ambit of the present invention to cover any obvious modifications of the preferred embodiment described herein, provided such modifications fall within the scope of the broad claims.

What is claimed is:

1. A gas turbine engine blade tip clearance control system comprising an annular housing, said housing formed about an engine casing to which an annular shroud segment assembly is secured and closely spaced about the blade tips of a stage of blades; said annular housing forming an air passage communicating with said casing for directing a cooling air stream to said engine casing, said engine casing being provided with an annular impingement passage formed therein in a wall surface opposite said annular shroud segment assembly, said impingement passage being defined between opposed spaced annular side walls of said casing, and a thermally operable passive ring valve; said ring valve being formed by two overlapped metal ring segments having a dissimilar coefficient of thermal expansion selected whereby to produce a radial gap between said ring segments when the temperature of said ring segments reaches a predetermined value, said radial gap admitting a cooling air flow into said housing for cooling said casing to control radial growth, said annular housing being formed by a ring valve support structure secured above said casing opposite said annular shroud segment assembly, said two overlapped metal rings being integrated in said support structure and being in facial contact, said radial gap being formed by a space between said metal rings when said rings separate from one another due to said dissimilar coefficient of thermal expansion, said radial gap being a variable radial gap the size of which is affected by the temperature of said metal rings to admit a metered cooling air flow to said casing.

2. A gas turbine engine blade tip clearance control system as claimed in claim 1 wherein said ring segments comprising a first annular metal plate secured across said annular side walls to form said annular housing, and a second annular metal plate having a lower coefficient of thermal expansion held captive under said first annular metal plate in close frictional contact with said first annular metal plate, support means for said second annular metal plate to permit thermal expansion of said first annular metal plate and said casing relative to said second annular metal plate, each said plate having air passages therethrough.

3. A gas turbine engine blade tip clearance control system as claimed in claim 2 wherein said air passages comprise holes provided in said first and second annular metal plates, said holes in said first plate being offset from said holes in said second plate.

4. A gas turbine engine blade tip clearance control system as claimed in claim 3 wherein there are fewer of said holes in said first annular metal plate, said holes in said second annular metal plate having a smaller cross-section than said holes in said first annular metal plate.

5. A gas turbine engine blade tip clearance control system as claimed in claim 2 wherein said support means is a cavity formed in a top inner edge section of each said annular side wall of said impingement passage, said cavities being aligned and dimensioned to permit displacement of said first plate and said casing relative to said second plate positioned thereacross when subjected to thermal expansion whereby to cause said plates to separate and permit air flow into said housing through said air passages and between said separated plates.

6. A gas turbine engine blade tip clearance control system as claimed in claim 5 wherein there is further provided restriction displacement means to maintain said plates substantially in facial alignment whereby said holes will be offset to shut off air flow when said plates are in tight facial contact with one another.

7. A gas turbine engine blade tip clearance control system as claimed in claim 2 wherein said first annular metal plate is made of a material which is the same as said engine casing.

8. A gas turbine engine blade tip clearance control system as claimed in claim 1 wherein said casing is provided with through bores to direct cooling air and hot combustion gas therethrough to cool or heat said casing.

* * * * *